US011435166B2

(12) United States Patent
Ball et al.

(10) Patent No.: US 11,435,166 B2
(45) Date of Patent: *Sep. 6, 2022

(54) METHOD FOR SHOCK ATTENUATION DEVICE USING A PIVOT MECHANISM

(71) Applicant: Qioptiq Limited, St. Asaph (GB)

(72) Inventors: Kenneth David Ball, Chester (GB); Mark Riley, Cilcain (GB); David A. Jones, Rhyl (GB)

(73) Assignee: Qioptiq Limited, St. Asaph (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/181,442

(22) Filed: Feb. 22, 2021

(65) Prior Publication Data

US 2021/0364255 A1 Nov. 25, 2021

Related U.S. Application Data

(60) Continuation of application No. 16/815,681, filed on Mar. 11, 2020, now Pat. No. 10,955,220, which is a (Continued)

(30) Foreign Application Priority Data

Mar. 6, 2018 (EP) ..... 18160173

(51) Int. Cl.
*F41G 11/00* (2006.01)
*F41G 1/41* (2006.01)
*F41G 1/387* (2006.01)

(52) U.S. Cl.
CPC ..... *F41G 11/002* (2013.01); *F41G 1/387* (2013.01); *F41G 1/41* (2013.01); *F41G 11/005* (2013.01);
(Continued)

(58) Field of Classification Search
CPC .... F41G 11/001; F41G 11/002; F41G 11/003; F41G 11/004; F41G 11/005; F41G 11/006; F41G 11/007; F41G 11/008
(Continued)

(56) References Cited

U.S. PATENT DOCUMENTS 3,969,982 A 7/1976 Pier-Armory et al.
4,027,414 A 6/1977 Felix
(Continued)

FOREIGN PATENT DOCUMENTS

DE 202012011835 U1 7/2013
WO 2009035735 3/2009
WO 2011075026 6/2011

OTHER PUBLICATIONS

Extended European Search Report for EP18160173.3 dated Nov. 23, 2018.

*Primary Examiner* — Joshua E Freeman
(74) *Attorney, Agent, or Firm* — Wolf, Greenfield & Sacks, P.C.

(57) ABSTRACT

A method for forming a weapon accessory mounting device to attach to a projectile firing weapon is disclosed. A flexure for receiving a body of the weapon accessory is formed. A pivot portion is formed at a first end of the flexure to attach the flexure to the weapon at a first attachment region. A second attachment portion is formed at a second end of the flexure to attach the flexure to the weapon at a second attachment region. A first aperture is formed in the pivot portion configured to receive a pivot pin. A second aperture in the weapon accessory body receives the pivot pin at a weapon accessory body first end to attach the weapon accessory body first end to the pivot portion. The pivot portion is configured to convert at least a portion of energy of a weapon shock recoil from translational energy to rotational energy.

9 Claims, 6 Drawing Sheets

Related U.S. Application Data division of application No. 15/955,979, filed on Apr. 18, 2018, now Pat. No. 10,605,571.

(52) U.S. Cl.
CPC ..... *F41G 11/007* (2013.01); *F41G 11/003* (2013.01)

(58) Field of Classification Search
USPC ..... 42/124
See application file for complete search history.

(56) References Cited

U.S. PATENT DOCUMENTS

| | | | | |
|---|---|---|---|---|
| 6,678,988 | B1 | 1/2004 | Poff, Jr. | |
| 7,780,363 | B1 * | 8/2010 | Holmberg | G03B 17/00 396/426 |
| 8,011,130 | B2 * | 9/2011 | Chang | F41G 11/002 42/124 |
| 8,024,884 | B2 * | 9/2011 | Holmberg | F41C 27/00 42/124 |
| 8,161,674 | B2 * | 4/2012 | Holmberg | F41C 27/00 42/90 |
| 8,205,375 | B1 | 6/2012 | Swan | |
| 9,038,302 | B1 | 5/2015 | Pochapsky | |
| 9,267,753 | B2 | 2/2016 | Dextraze | |
| 9,689,645 | B2 | 6/2017 | Bouquet | |
| 2003/0056417 | A1 * | 3/2003 | Horton | F41G 11/007 42/124 |
| 2010/0162611 | A1 | 7/2010 | Samson et al. | |
| 2010/0275494 | A1 | 11/2010 | Chang et al. | |
| 2010/0313462 | A1 * | 12/2010 | Holmberg | F41G 11/004 42/124 |
| 2011/0047855 | A1 | 3/2011 | Wong | |
| 2013/0145666 | A1 | 6/2013 | Eriksson et al. | |
| 2013/0283659 | A1 | 10/2013 | Trapp et al. | |
| 2013/0305584 | A1 | 11/2013 | Cosentino | |
| 2015/0276351 | A1 | 10/2015 | Pekarek et al. | |

* cited by examiner

METHOD FOR SHOCK ATTENUATION DEVICE USING A PIVOT MECHANISM

CROSS-REFERENCE TO RELATED APPLICATIONS

This application is a continuation of U.S. application Ser. No. 16/815,681, entitled Method For Shock Attenuation Device Using A Pivot Mechanism, which is a divisional of U.S. application Ser. No. 15/955,979, entitled Shock Attenuation Device and Method Using a Pivot Mechanism and filed on Apr. 18, 2018, which claims priority to European application number 18160173.3 entitled Shock Attenuation Device and Method Using a Pivot Mechanism and filed on Mar. 6, 2018, which are both incorporated by referenced herein in their entirety.

FIELD OF THE INVENTION

The present invention relates to shock attenuation, and more particularly, is related to a weapon mount for an optical device.

BACKGROUND OF THE INVENTION

Weapon mounted accessories often incorporate shock attenuation mechanisms to protect the accessories from the shock resulting from discharge of the weapon. Shock attenuation has been achieved to varying degrees of success using one or more of damping/soft materials such as rubber, flexures, springs, preloading techniques, pneumatics/hydraulics, inertia, geometrical stiffness, material selection, torsion bars, and McPherson struts (and other vehicle suspension solutions), among others.

Weapon mountable accessories are often attached to a weapon by a rail system. While the rail systems are convenient, they may transmit recoil shock from the discharged projectile to the accessory, which may damage the accessory, for example, delicate optics, such as a weapon image intensification (II) tube. Flexures have been implemented in such mounting systems such that the flexures absorb and/or dissipate shock energy rather than transmitting the shock energy to the accessory, as shown in FIG. 1A. A weapon mounted accessory 110, a sight in this instance, is mounted via flexures 150 attached by connectors 160 to a weapon mounted rail. The flexures 150 provide a pure translational movement oriented along the rail 190, as indicated by the arrows. However, orientating flexures 150 in this manner may require a space envelope, of the order of several millimetres for example, which may not be available in some applications. Such translational flexures 150 may also introduce undesirable secondary modes, as shown in FIG. 1B, which may degrade performance. Also, translational flexures 150 may suffer from high stresses under extreme shocks, and may thus be susceptible to failure and/or permanent distortion. Finally, translational flexures are often not adequate to provide sufficient attenuation. Therefore, there is a need in the industry to address one or more of the abovementioned shortcomings.

SUMMARY OF THE INVENTION

Embodiments of the present invention provide a method for a shock attenuation device using a pivot mechanism. Briefly described, the present invention is directed to a method for forming a weapon accessory mounting device configured to attach to a projectile firing weapon.

A flexure configured to receive a body of the weapon accessory is formed. A pivot portion is formed at a first end of the flexure to attach the flexure to the weapon at a first attachment region. A second attachment portion is formed at a second end of the flexure to attach the flexure to the weapon at a second attachment region. A first aperture is formed in the pivot portion configured to receive a pivot pin. A second aperture in the weapon accessory body receives the pivot pin at a weapon accessory body first end to attach the weapon accessory body first end to the pivot portion. The pivot portion is configured to convert at least a portion of energy of a weapon shock recoil from translational energy to rotational energy.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The accompanying drawings are included to provide a further understanding of the invention, and are incorporated in and constitute a part of this specification. The components in the drawings are not necessarily to scale, emphasis instead being placed upon clearly illustrating the principles of the present invention. The drawings illustrate embodiments of the invention and, together with the description, serve to explain the principles of the invention.

DETAILED DESCRIPTION

The following definitions are useful for interpreting terms applied to features of the embodiments disclosed herein, and are meant only to define elements within the disclosure.

As used within this disclosure, a "flexure" refers to a flexible element such as a rod, beam or spring, or a combination of elements engineered to provide specified low stiffness whilst maintaining structural integrity under deformation and load.

As used within this disclosure, a "pivoting flexure" is a flexure with a hinge or pivot mechanism such as a pin incorporated into an end portion of the flexure, providing an axis for rotational movement around the hinge or pivot pin.

As used within this disclosure, "substantially" means "very nearly", for example, within manufacturing tolerances.

As noted in the background section, obtaining shock attenuation of gunfire sufficient to protect delicate optics (such as image intensifier tubes and many others), whilst providing structural integrity over many high acceleration pulses, is difficult to achieve in small space envelopes and with low mass. Flexure methods have been made to work in the past but are limited in these respects. For example, prior flexures in weapon accessory mounting systems intended to absorb and/or dissipate translational shock energy may require significant space along a weapon rail, may introduce degrading secondary modes, and/or may be highly stressed and of limited acceleration attenuation.

Figure 1A:
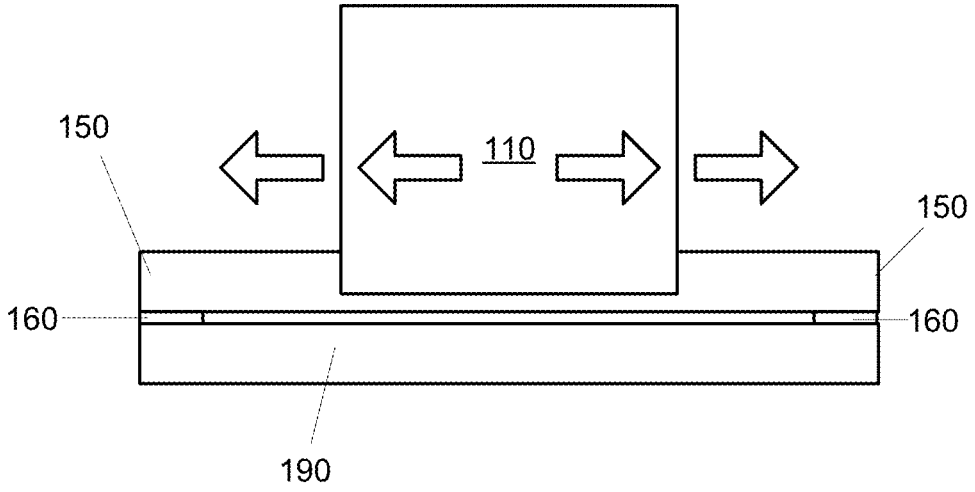
FIG. 1A (Prior Art)
FIG. 1A is a schematic diagram of a prior art weapon mounting flexure indicating translational motion.
Figure 1B:
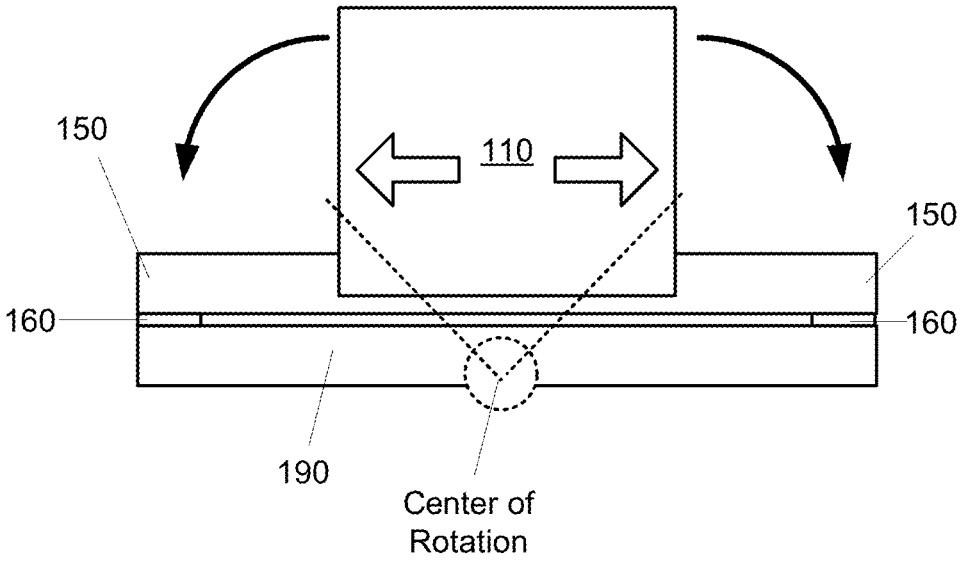
FIG. 1B (Prior Art)
FIG. 1B is a schematic diagram of a prior art weapon mounting flexure indicating translational and rotational motion.
Figure 2:
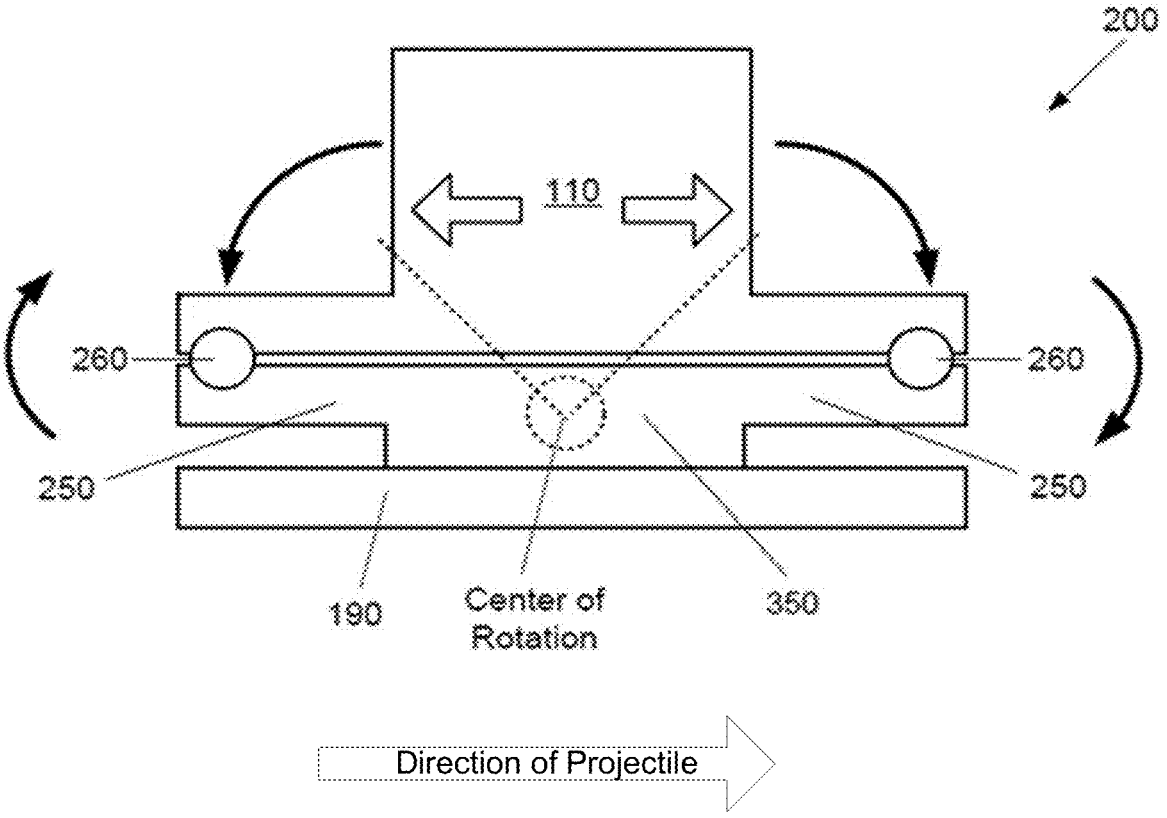
FIG. 2 is a schematic diagram of a first embodiment of a weapon accessory mounting device providing pivoting flexures.

FIG. 2 shows a schematic diagram of a first embodiment of a weapon accessory mounting device 200 providing pivoting flexures 250. The pivoting flexures utilize one or more pivots 260 at the end of the flexures 250 and a weapon bracket 350 (FIG. 3) with a rotational eigenmode to provide an equivalent axial motion at the point of interest, in this case, at the location of the weapon mounted accessory 110 within the weapon accessory mounting device 200. The first embodiment uses pivoting flexures 250 which may be orientated in a completely different direction from traditional flexures, in this embodiment, by flexing in a direction normal (normal to the rail 190) to the critical direction (translational along the rail 190), thereby allowing the pivoting flexures 250 to fit into a smaller space envelope than non-pivoting flexures. For example, the first embodiment may be configured to fit into a space envelope in the order of 80×50×5 mm.

For example, for a non-pivoting flexure with a single fixed end, the maximum deflection for the non-fixed end may be modeled as:

$$\frac{-Wl^3}{12EI} \quad \text{(Eq. 1)}$$

where W is the load, l is the length of the flexure beam, E is the modulus of elasticity for the beam material and I is the area moment of inertia. This equates to a first resonant frequency f of:

$$f = 0.55\sqrt{\frac{EIa}{Wl^3}} \quad \text{(Eq. 2)}$$

where a is the length of the portion of the non-fixed end extending beyond a location where the load W is applied.

In contrast, under the first embodiment, the maximum deflection for the non-fixed end may be modeled as:

$$\frac{-Wl^3}{3EI} \quad \text{(Eq. 3)}$$

with a first resonant frequency of:

$$f = 0.27\sqrt{\frac{EIa}{Wl^3}} \quad \text{(Eq. 4)}$$

As shown here, the first embodiment reduces the first mode to 50% of the non-pivoting flexure. For example, a mode of 700 Hz may advantageously reduce to around 350 Hz.

Although shocks may be applied in all directions, such as the pyrotechnic explosions experienced under gunfire, the shocks are controlled to launch a projectile in a single direction. Hence the highest shock levels tend to predominate along the axis of the direction the projectile is fired. This direction also coincides with the most susceptible axis of damage to devices such as image intensifier tubes. Therefore, the first embodiment, although applicable for reducing shock in all directions, may be specifically employed to concentrate on attenuating shocks in that single direction. It should also be noted the alignment of the flexures as described here provides a similar beneficial attenuation protection in the direction normal to the top of the rail of the weapon and reduced benefit in any remaining directions.

Figure 3:
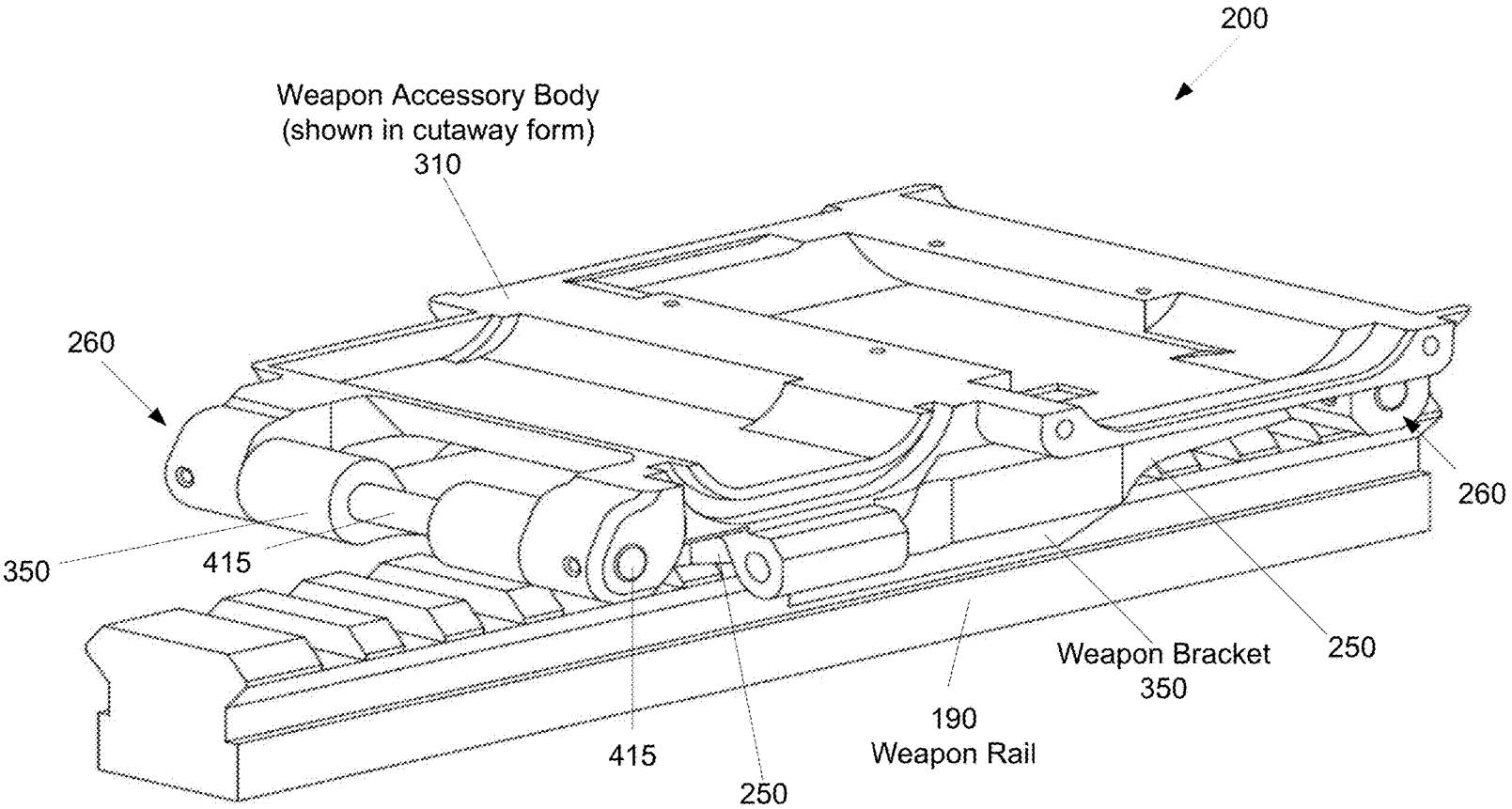
FIG. 3 is a more detailed schematic diagram of the weapon accessory mounting device of FIG. 2 from a perspective angle.

FIG. 3 is a more detailed schematic diagram of the weapon accessory mounting device 200 from a perspective angle with a weapon accessory body 310 depicted omitting most of the weapon mounted accessory 110 (FIG. 2) for clarity. The weapon accessory body 310 is attached to a weapon bracket 350, which is in turn attached to the weapon mounted accessory rail 190.

Figure 4:
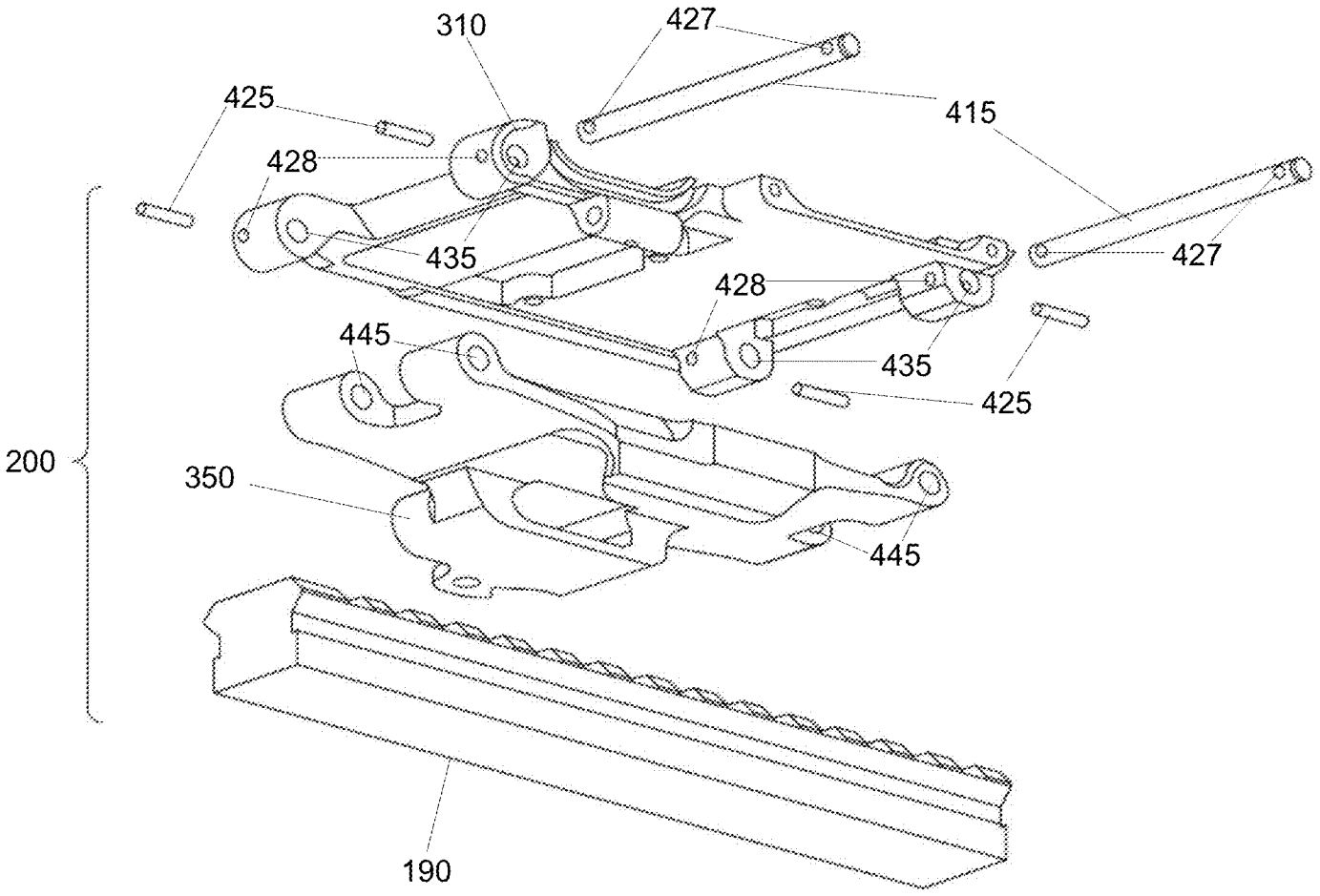
FIG. 4 is an exploded view schematic diagram of the weapon accessory mounting device of FIG. 3.

The exploded view of FIG. 4 may offer more clarity of the weapon accessory mounting device 200 than FIG. 3. In particular the pivots 260 (FIG. 2) may include several individual elements, such as pivot pins 415 that are inserted through body location holes 435 in the weapon accessory body 310, and bracket location holes 445 in the weapon bracket 350, and associated affixing pieces, such as spirol pins 425. Alternative embodiments may incorporate different mechanisms for retaining the pivots into the body.

The weapon bracket 350 is attached to the weapon accessory body 310 using the pivot pins 415. The weapon bracket 350 is located laterally in-between the four lugs of the weapon accessory body 310. In alternative embodiments, a different number of lugs/bosses may be used, or other attachment mechanisms may be used. The pivot pins 415 locate the weapon accessory body 310 with respect to the weapon bracket 350 longitudinally and vertically. The weapon bracket 350 can flex due to the flexures 250 and/or rotate about the axes of the pivot pins 415. In this embodiment, the range of rotational movement in the pivots may be very small, for example several (0-10) degrees. For other embodiments, the rotational range may be much bigger. The freedom for at least partial rotational movements provided by the pivots 260 allows for a reduction in stiffness that is a key benefit to this configuration. While the first embodiment illustrates pivot pins 415 inserted through the weapon bracket 350, any type of connector/connection that allows similar rotational freedom at the ends of the weapon bracket 350 may be used.

The weapon accessory body 310 may be attached via a pivot mechanism formed by inserting pivot pins 415 through body location holes 435 in the weapon accessory body 310, and bracket location holes 445 in the weapon bracket 350. The body location holes 435 and the bracket location holes 445 may be disposed at fore and aft portions of the weapon accessory body 310 and the weapon bracket 350 respectively. In general, longer flexures may provide more movement/flexibility and therefore greater shock attenuation. Practically, the available space provided for a particular application may limit the flexure length. The pivots 260 allow greater flexibility in a smaller package size when compared with a non-pivoting flexure.

Under the first embodiment, the pivot pins 415 may include securing holes 427 at each end of the pivot pins 415 that may be used to secure the pivot pins 415 to the weapon accessory body 310 and/or the weapon bracket 350. Spirol pins 425 may be inserted through holes 428 in the pivot portions of the weapon accessory body 310 and similarly through the securing holes 427 in the pivot pins 415 to secure the pivot pins within the location holes 435, 445. Alternative embodiments may use different mechanisms for retaining the pivot pins 415 in the weapon accessory body 310, for example, spirol pins, dowel pins, screws, locking wire, circlips or adhesive etc.

While the fore and aft pivots 260 may each respectively use a single pivot pin 415 along the entire length of the pivots 260, in alternative embodiments each pivot may instead use two or more shorter pivot pins 415 sharing a common rotational axis inserted through the location holes 435, 445 that do not extend the entire length of the pivots 260. Other types of pivot mechanisms are also possible.

While under the first embodiment the weapon accessory mounting device 200 includes two pivots 260, namely a fore pivot and an aft pivot, in alternative embodiments the weapon accessory mounting device 200 may have a single pivot 260, for example, either a fore pivot 260 or an aft pivot 260, while the end opposite the pivot 260 may be attached without a pivot or pivot mechanism.

Figure 5A:
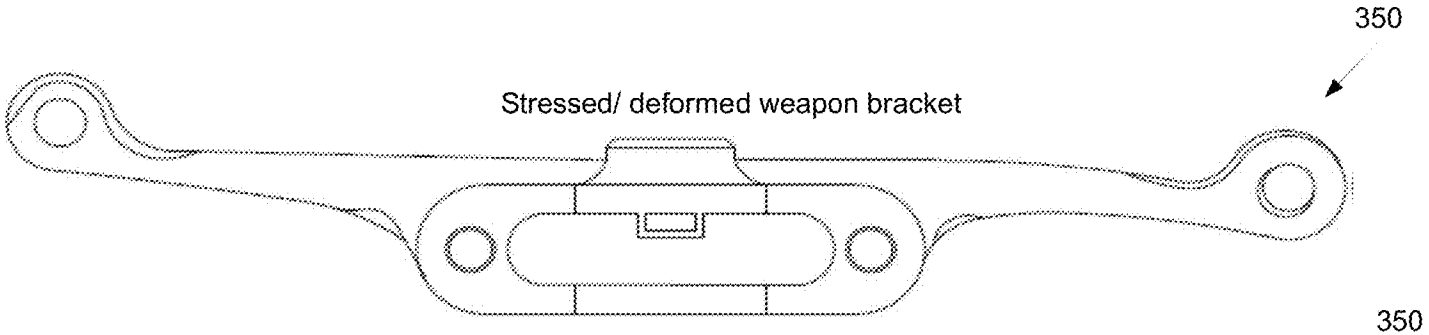
FIG. 5A is a schematic diagram isolating a weapon bracket of the weapon accessory mounting device of FIG. 3 shown as deformed under the transient stress of a weapon discharge recoil.
Figure 5B:
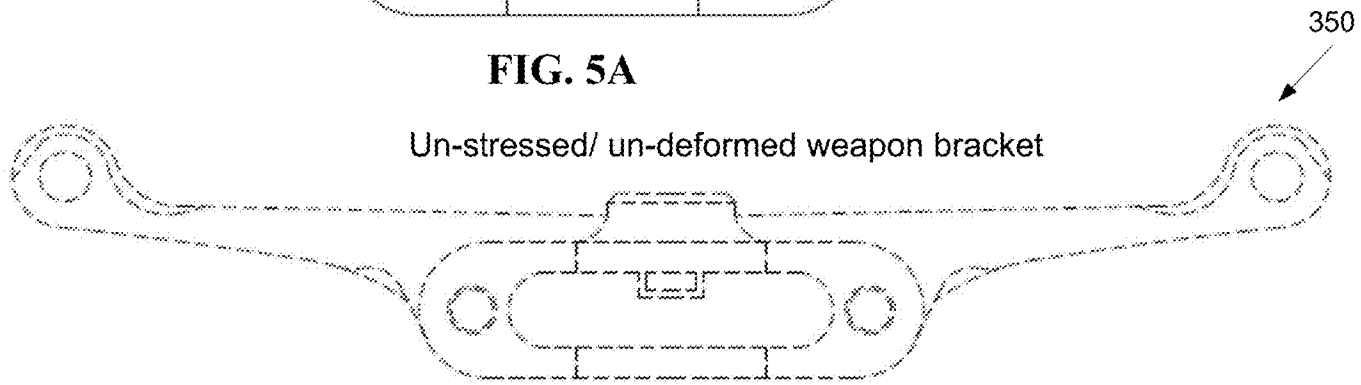
FIG. 5B is a schematic diagram isolating a weapon bracket of the weapon accessory mounting device of FIG. 3 shown without the stress of a weapon discharge recoil.
Figure 5C:
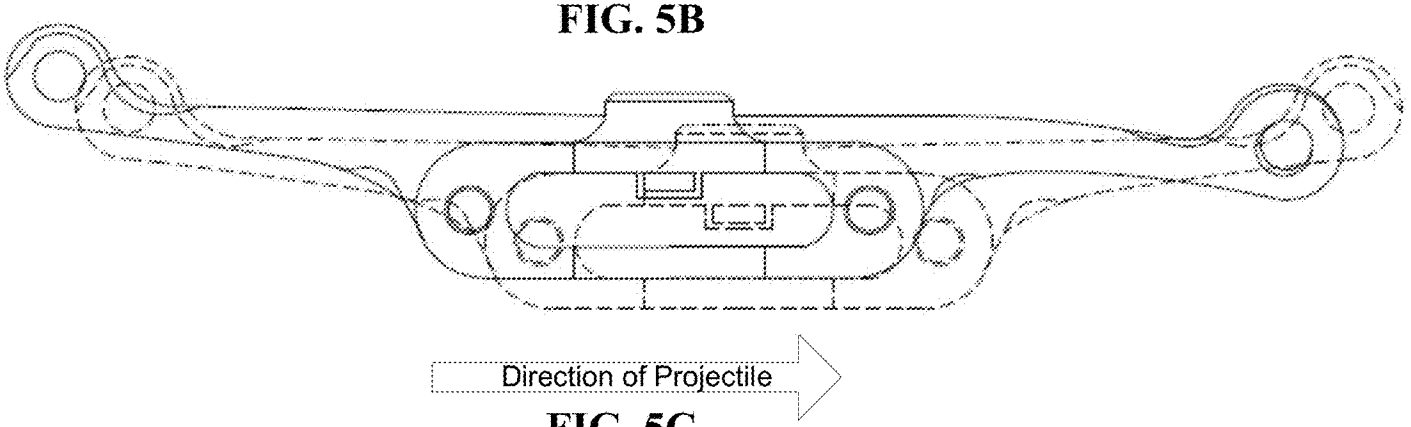
FIG. 5C is a schematic diagram overlaying FIGS. 5A and 5B.

FIG. 5A is a schematic diagram isolating a weapon bracket 350 of the weapon accessory mounting device 200 of FIG. 3 shown as deformed under the transient stress of a weapon discharge recoil. FIG. 5B is a schematic diagram isolating a weapon bracket 350 of the weapon accessory mounting device 200 of FIG. 3 shown without the stress of a weapon discharge recoil. FIG. 5C is a schematic diagram overlaying FIGS. 5A and 5B. An arrow shows the direction the projectile is fired by the weapon.

Incorporating a pivot 260 at the end of one or more of the flexures 250 allows for rotation of the flexure 250 at the pivoted end. This significantly reduces recoil induced acceleration of the weapon mounted accessory 110 (FIG. 2), for example reducing acceleration by up to 50 percent in comparison with a flexure without a pivoted end. While under the first embodiment, the flexures 250 may be implemented as a rod or beam formed of a suitably rigid material, in alternative embodiments, the other flexure configurations may be employed, for example springs.

While flexures have been used in many devices, the orientation of the flexures 250 combined with the rotational freedom afforded by the pivots in the first embodiment is new in this application of attenuating pyrotechnic shock on sensitive and/or fragile optical devices, orientating the flexures 250 to utilize a rotational rather than a linear eigenmode, to provide an enhanced linear protection. The pivots 260 change the degree of fixation at the end of the flexures 250, thereby permitting greater displacements to take place. The pivots 260 may be mechanically arranged to permit free rotation on one or more attached components. The pivots 260 provide an increased degree of movement, thereby providing increased shock isolation. Additional pivots may provide increased movement, but at the expense of increased complexity. Under a preferred embodiment, the flexures 250 are made of aluminum alloy and the pivot pins 415 are made of titanium alloy, but other embodiments are not limited to these materials. Material used for the flexures 250 preferably provides low stiffness and high strength, for example, titanium, beryllium, copper, or spring steel, among others. Material for the pivot pins preferably provides high strength and low friction, for example steel and/or aluminum, among others. Coatings for such materials may also be used to enhance these desirable qualities. The pivot principle enforces the flexures 250 to behave like cantilevers, rather than beams with built in ends, thereby potentially quadrupling the movement at the pivot of the flexure.

The flexures 250 (FIG. 2) enable the weapon mounted accessory 110 (FIG. 2) to be protected by permitting it to move a significantly large distance, for example, several millimetres, when shock is applied, for example, on the order of 1000 g to 2000 g, thereby reducing the peak levels of acceleration. The pivot mechanisms 260 (FIG. 2) provide amplification of this displacement, to significantly decrease the peak acceleration further, thereby achieving satisfactory protection of the weapon mounted accessory 110 (FIG. 2) where it may not otherwise be possible in the same space envelope. The flexures 250 (FIG. 2) may also avoid other undesirable side effect modes, for example higher stress values in the mounting components, and/or very low modes, for example, on 100 Hz down to 50 Hz or below, in directions other than parallel to the projectile path.

The first embodiment enforces a step change in the flexibility capability of flexures, without the requirement for increased space envelope and mass, thereby providing shock attenuation levels using devices hitherto not possible, and without the need for complex mechanisms.

While the first embodiment depicts the weapon accessory mounting device 200 attaching to a weapon via a rail, in alternative embodiments the weapon accessory mounting device 200 may attach directly to the weapon, for example, to the barrel of the weapon, without a rail. For example, the weapon accessory mounting device 200 may attach to the weapon via a pivot located between the flexure 250 and a pivot portion attached directly to the barrel of the weapon, or to another portion of the weapon.

Method

Figure 6:
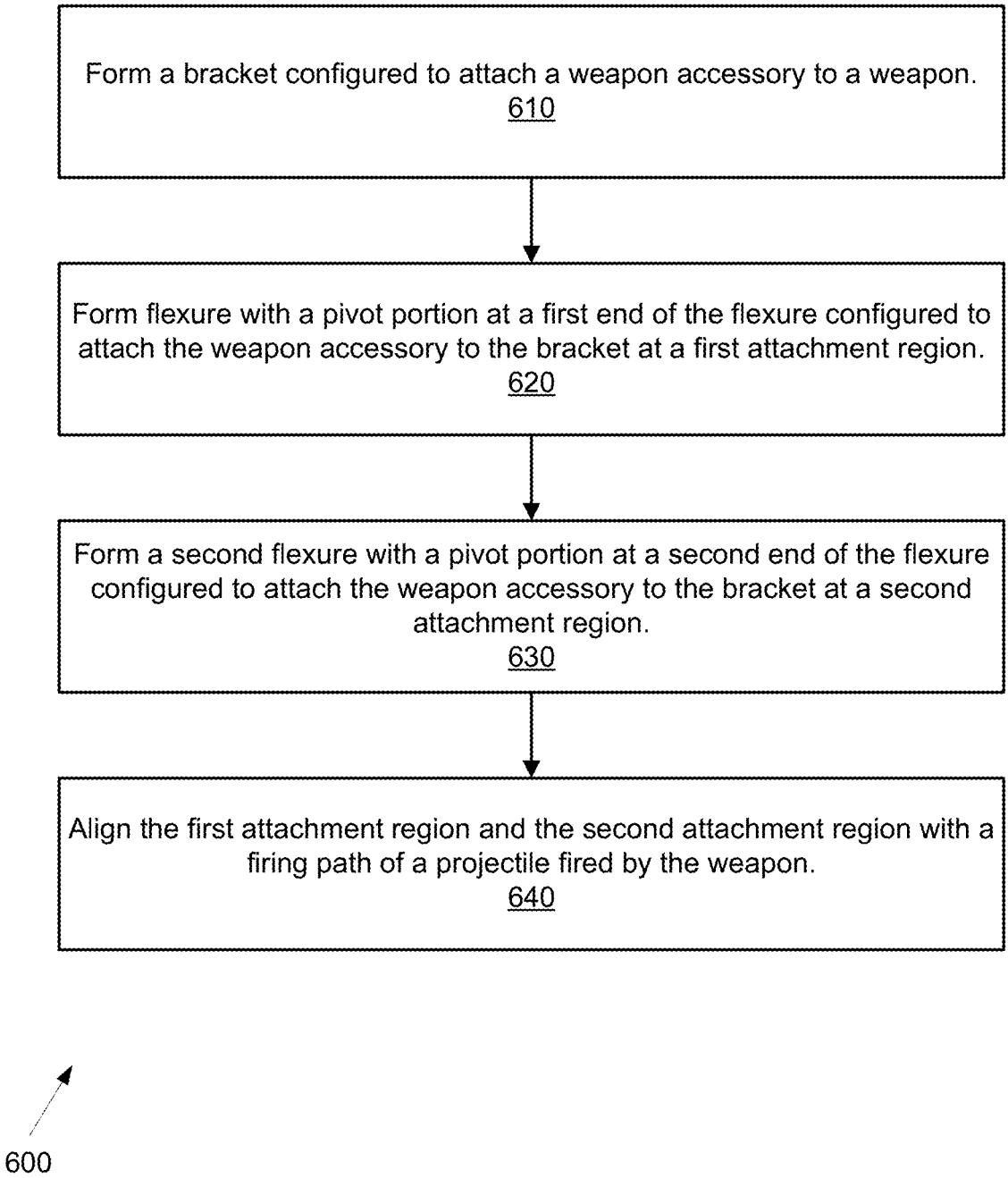
FIG. 6 is a flowchart of a first embodiment of a method for forming a weapon accessory mounting device.

FIG. 6 is a flowchart 600 of a first embodiment of a method for forming a weapon accessory mounting device. It should be noted that any process descriptions or blocks in flowcharts should be understood as representing modules, segments, portions of code, or steps that include one or more instructions for implementing specific logical functions in the process, and alternative implementations are included within the scope of the present invention in which functions may be executed out of order from that shown or discussed, including substantially concurrently or in reverse order, depending on the functionality involved, as would be understood by those reasonably skilled in the art of the present invention. The flowchart 600 is described below with reference to FIG. 3.

A weapon bracket 350 to attach to a weapon is formed as shown by block 610. For example, the bracket and flexures may be formed of an aluminum alloy. The bracket is formed with a flexure 250 with a pivot 260 portion at the end of the flexure configured to attach the weapon accessory body 310 at a first attachment region as shown by block 620. A second attachment region is formed at the pivot portion 260 at the end of a second flexure 250 as shown by block 630.

The first attachment region and the second attachment region may be aligned with a firing path of a projectile fired by the weapon, for example, a line drawn between a point representing the first attachment region and a point representing the second attachment region may be parallel to the rail and/or projectile, as shown by block 640, however, other attachment region orientations are possible.

It will be apparent to those skilled in the art that various modifications and variations can be made to the structure of the present invention without departing from the scope or spirit of the invention. For example, friction at the pivot 260 may be leveraged to ensure rotation occurs. This may be achieved by bearings rather than direct material contact, for example. Alignment of the flexures 250 to the pivots 260 may be considered to provide the correct protection, which may involve additional and/or alternative orientations. The shape of the flexures 250 need not be flat nor constant thickness; any geometrical variation is possible providing it is considered satisfactory to the intended application in the design analysis. Springs may be used instead of flexures 250, although these may interact less efficiently with the pivots 260. Single and/or multiple flexures 250 may be used. There is no restriction to the use of two as shown in the illustrations. Multi-pivots may be employed with multiple flexures and/or links. In view of the foregoing, it is intended that the present invention covers modifications and variations of this invention provided they fall within the scope of the following claims and their equivalents.

What is claimed is:

1. A method for forming a weapon accessory mounting device configured to attach to a projectile firing weapon, comprising the steps of:

forming a flexure configured to receive a weapon accessory body of a weapon accessory;

forming a first pivot portion at a first end of the flexure configured to attach the flexure to the weapon accessory body at a first attachment region;

forming a second attachment portion at a second end of the flexure configured to attach the flexure to the weapon accessory body at a second attachment region;

arranging an axis of the first pivot portion in a direction substantially normal to a projectile path direction; and forming a first aperture in the first pivot portion configured to receive a first pivot pin, wherein the weapon accessory body further comprises a second aperture configured to receive the first pivot pin at a weapon accessory body first end to attach the weapon accessory body first end to the first pivot portion.

2. The method of claim 1, wherein forming the flexure further comprises forming a weapon bracket comprising a first end and a second end, the weapon bracket first end attached to the first pivot portion, wherein the flexure is configured to attach to the projectile firing weapon via the weapon bracket.

3. The method of claim 1, wherein the second attachment portion comprises a second pivot portion.

4. The method of claim 3, further comprising the step of arranging an axis of the second pivot portion in a direction substantially normal to the projectile path direction.

5. The method of claim 3, further comprising the step of forming a third aperture in the second pivot portion configured to receive a second pivot pin, wherein the weapon accessory body further comprises a fourth aperture configured to receive the second pivot pin at a weapon accessory body second end to attach the weapon accessory body second end to the second pivot portion.

6. The method of claim 1, wherein first pivot portion is configured to convert at least a portion of energy of a shock recoil of the projectile firing weapon from translational energy to rotational energy.

7. The method of claim 5, wherein the first pivot portion and the second portion are configured to convert at least a portion of energy of a shock recoil of the projectile firing weapon from translational energy to rotational energy.

8. The method of claim 3, wherein forming the flexure further comprises forming a weapon bracket comprising a first end and a second end, the weapon bracket first end attached to the first pivot portion, the weapon bracket second end attached to the second pivot portion, wherein the flexure is configured to attach to the projectile firing weapon via the weapon bracket.

9. The method of claim 3, wherein forming the flexure further comprises forming a weapon bracket comprising a first end and a second end, the weapon bracket first end attached to the first pivot portion, the weapon bracket second end attached to the second pivot portion, wherein the flexure is configured to receive the weapon accessory via the weapon bracket.

* * * * *